US005247722A

United States Patent [19]

Leifeld

[11] Patent Number: 5,247,722

[45] Date of Patent: Sep. 28, 1993

[54] METHOD AND APPARATUS FOR PNEUMATICALLY INTRODUCING FIBER TO A FIBER PROCESSING MACHINE

[75] Inventor: Ferdinand Leifeld, Kempen, Fed. Rep. of Germany

[73] Assignee: Trützschler GmbH & Co. KG, Mönchengladbach, Fed. Rep. of Germany

[21] Appl. No.: 872,760

[22] Filed: Apr. 24, 1992

Related U.S. Application Data

[63] Continuation-in-part of Ser. No. 656,689, Feb. 19, 1991, abandoned.

[30] Foreign Application Priority Data

Feb. 22, 1990 [DE] Fed. Rep. of Germany ..... 4005642
Nov. 30, 1990 [DE] Fed. Rep. of Germany ..... 4038150

[51] Int. Cl.[5] ..... D01G 15/40; B65G 51/16

[52] U.S. Cl. ..... 19/105; 19/205; 406/14

[58] Field of Search ..... 19/105, 204, 205, 145.7, 19/300, 303, 65 R, 66 R; 406/171, 175, 14

[56] References Cited

U.S. PATENT DOCUMENTS 3,580,644 5/1971 Ballard, Jr. ..... 406/171
3,709,406 1/1973 Binder et al. ..... 406/171
4,176,988 12/1979 Lattmann et al. ..... 406/171
4,701,981 10/1987 Leifeld ..... 19/105

FOREIGN PATENT DOCUMENTS 000033 12/1978 European Pat. Off. .
811578 6/1951 Fed. Rep. of Germany ..... 406/14
1414893 8/1988 U.S.S.R. ..... 19/105
800877 9/1958 United Kingdom .
1075144 7/1967 United Kingdom .
2030327 4/1980 United Kingdom ..... 19/105
1580653 12/1980 United Kingdom .

*Primary Examiner*—Clifford D. Crowder
*Assistant Examiner*—Michael A. Neas
*Attorney, Agent, or Firm*—Spencer, Frank & Schneider

[57] ABSTRACT

An apparatus for pneumatically delivering fiber tufts to a fiber processing machine includes a duct; a blower having a pressure side communicating with the duct for pneumatically driving fiber tufts therein in a stream $M_1$; a branch conduit extending from the duct at a branch-off location situated downstream of the blower as viewed in a direction of flow of the stream $M_1$ for separating a stream $M_3$ from the stream $M_1$, leaving a stream $M_2$ to proceed in the duct downstream of the branch-off location; and a flow varying arrangement for changing a flow rate of the stream $M_3$ in the branch conduit. The flow varying arrangement has a throttle mechanism situated in the branch conduit.

32 Claims, 5 Drawing Sheets

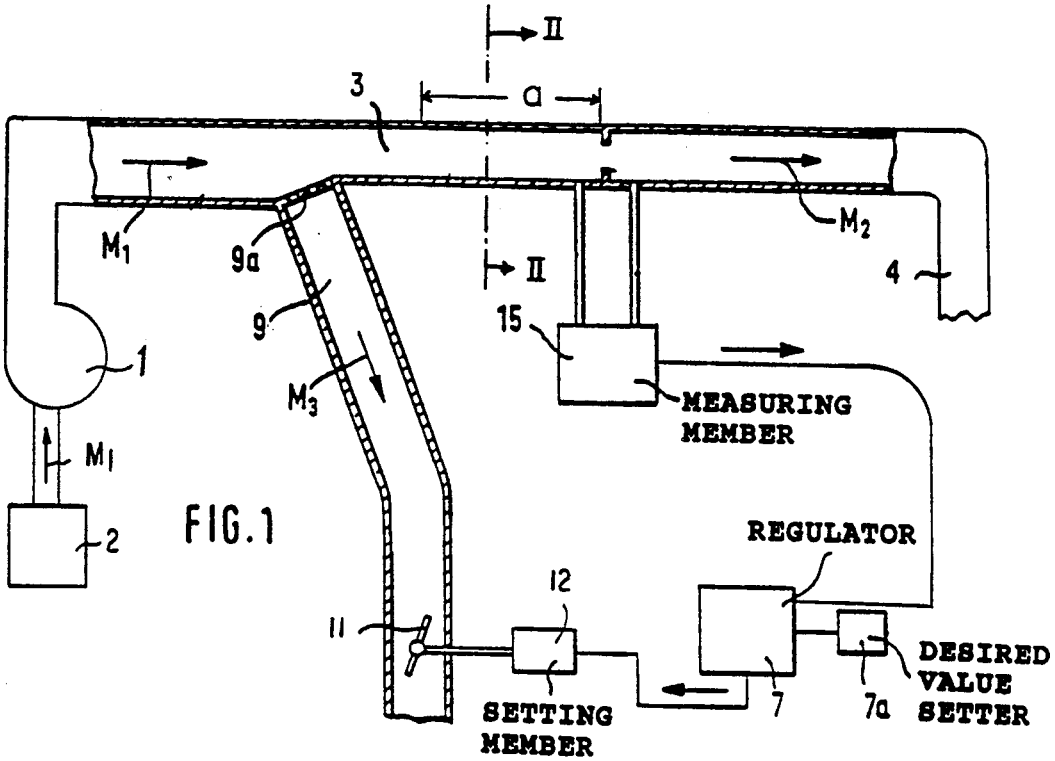
FIG.1
FIG.2
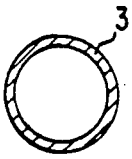
FIG.3
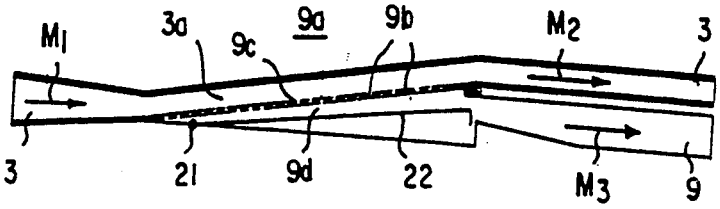

METHOD AND APPARATUS FOR PNEUMATICALLY INTRODUCING FIBER TO A FIBER PROCESSING MACHINE

CROSS REFERENCE TO RELATED APPLICATION

This is a continuation-in-part of application Ser. No. 07/656,689, filed Feb. 19, 1991, now abandoned.

Further, this application claims the priority of Federal Republic of Germany Application Nos. P 40 05 642.2 filed Feb. 22, 1990 and P 40 38 150.1, filed Nov. 30, 1990.

BACKGROUND OF THE INVENTION

This invention relates to a method and an apparatus for pneumatically feeding fiber tufts to at least one fiber processing machine such as a carding machine, and is in particular concerned with the control and regulation of the flow rate of the air/fiber stream in the pneumatic duct leading toward the fiber processing machine. The pneumatic duct may deliver fiber tufts, for example, from a fine opener to a separate feed chute arranged upstream of each fiber processing machine. The conveying air stream is generated by a blower arranged in the fiber transporting duct.

In fiber tuft supplying systems, particularly those operating pneumatically, the operation may be adversely affected in case the air quantities emanating from the fiber supplying machines (such as the above-noted fine opener) and the fiber quantities admitted to the target machines (such as a fiber tuft feed chute for a carding machine) are not identical for an optimal operation. Thus, in a known arrangement drawbacks have been encountered in case the air streams or pressures fluctuate over time. In case the fiber transporting duct is not airtight, an air stream $M_3$ may cape. The flow rate of an airstream $M_1$ (which is present in the pneumatic duct from the pressure side of the blower to the escape location of the air stream $M_3$), an air stream $M_2$ (which is present from the escape location of the air stream $M_3$ to the target machine) and the air stream $M_3$ are coordinated for a determined operational point, for example, for a counterpressure $p_2$. In case the pressure $p_2$ changes, for example, because of a varying fill height in the feed chutes or because of a change in the number of consumer machines (such as carding machines), then in case of a throttling of the air stream $M_2$, the flow rate of the air stream $M_3$ increases unproportionately. This results in the disadvantage that a pressure build-up for $p_2$—which is technologically required for an optimal filling effect—cannot take place.

SUMMARY OF THE INVENTION

It is an object of the invention to provide an improved method and apparatus for controlling and regulating the air/fiber stream in a pneumatic conveying duct of a fiber tuft processing line.

This object and others to become apparent as the specification progresses, are accomplished by the invention which is incorporated in a fiber processing line and according to which, briefly stated, the apparatus for pneumatically delivering fiber tufts to a fiber processing machine includes a duct; a blower having a pressure side communicating with the duct for pneumatically driving fiber tufts therein in a stream $M_1$; a branch conduit extending from the duct at a branch-off location situated downstream of the blower as viewed in a direction of flow of the stream $M_1$ for separating a stream $M_3$ from the stream $M_1$, leaving a stream $M_2$ to proceed in the duct downstream of the branch-off location; and a flow varying arrangement for changing a flow rate of the stream $M_3$ in the branch conduit. The flow varying arrangement has a throttle mechanism situated in the branch conduit.

By virtue of the invention a controlled escape of an air stream $M_3$ from the stream $M_1$ in the pneumatic distributor duct is effected, thus controlling indirectly the stream $M_2$ in the pneumatic distributor duct after branching off the stream $M_3$. By practicing the invention, output ranges may be obtained which would not be otherwise possible.

The invention has, among others, the following additional features which may be present individually and/or in combination:

The flow rate of the air stream $M_3$ may be sensed directly or indirectly in the distributor duct. The flow rate of the air stream $M_2$ may be measured directly or indirectly in the distributor duct and/or in the feed chutes. The air pressure $p_2$ is measured in the distributor duct and/or in the feed chutes. A flow rate control device, such as a butterfly valve is installed in the branch conduit which is connected to a suction source with the intermediary of a filter. A control and/or regulating device is provided which is connected with the measuring members for the flow rate of the air stream $M_2$ and/or the sensor for the air pressure $p_2$ and a setting member for setting the flow rate of the air stream $M_3$ in the branch conduit. The control and/or regulating device is connected with the measuring device for the flow rate of the air stream $M_1$ and/or the air stream $M_2$ as well as the setting member for setting the flow rate for the air stream $M_3$ in the branch conduit. A memory arranged to store desired values is connected with the control and/or regulating device which may comprise a microcomputer. The control and/or regulating device is connected with a desired value inputter which is connected with the measuring member that senses the flow rate of the air stream $M_2$. The measuring member for the flow rate of the air stream $M_2$ is situated between the branching location of the branch conduit and the feed chutes.

BRIEF DESCRIPTION OF THE DRAWING

FIG. 1 is a schematic sectional view, with block diagram, of a preferred embodiment of the invention.

FIG. 2 is a sectional view taken along line II—II of FIG. 1.

FIG. 3 is a schematic sectional view of a preferred embodiment of a component forming part of the invention.

DESCRIPTION OF THE PREFERRED EMBODIMENTS

Figure 4:
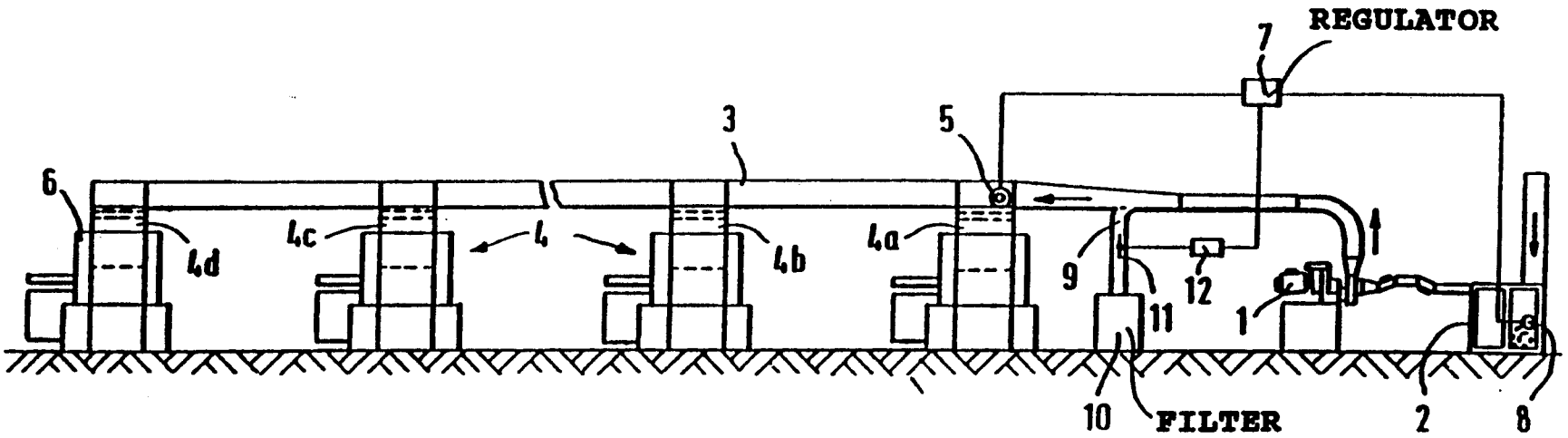
FIG. 4 is a schematic side elevational view of a fiber feeding system for a plurality of carding machines, incorporating the invention.

FIG. 1 illustrates the principle of the invention in a simple example. In a fiber processing line a fine opener 2 discharges finely opened fiber tufts which are carried in a pneumatic distributor duct 3 in an air stream generated by a blower 1 whose suction side is connected to the output of the fine fiber opener 2. The distributor duct 3 supplies fiber, for example, to a card feeder 4. The fiber/air stream at the output of the blower 1 is designated at $M_1$. From the distributor duct 3, at a branching location 9a, at a location between the output of the blower 1 and the input of the card feeder 4, from the distributor duct 3 a branch conduit 9 extends which communicates with the duct 3 through apertures 9b whose size is smaller than the smallest expected dimensions of the fiber tufts to prevent the fiber tufts from entering the branch conduit 9. The branch conduit 9 separates an air stream $M_3$ from the stream $M_1$, leaving a fiber/air stream $M_2$ to proceed downstream of the branch location 9a towards the card feeder 4.

If it is, for example, desired to maintain a certain flow rate of the stream $M_2$, such desired flow rate is inputted in a desired value setter 7a which is connected to a regulator 7. The regulator 7, in turn, controls a setting member 12 which, accordingly, alters the position of a gate, such as a butterfly valve 11 disposed in the branch conduit 9. Thus, if, for example, the flow rate of the stream $M_2$ drops, such a change is sensed by a flow rate sensor 15 connected to an input of the regulator 7 which, in response to a signal representing such a flow rate change, adjusts the setting of the butterfly valve 11 to reduce the flow rate of the stream $M_3$ in the branch conduit 9, whereupon, given the equation $M_1=M_2+M_3$, the flow rate of the stream $M_2$ increases until the set desired value is reached.

Also, if, for example, it is desired to decrease the flow rate of the stream $M_2$, by accordingly adjusting the desired value setter 7a, the desired value may be arbitrarily brought down to the desired magnitude causing the butterfly valve 11 to increase the cross-sectional flow passage opening of the branch conduit 9, whereby the flow rate will increase there, simultaneously causing an appropriate desired reduction of the flow rate of the stream $M_2$ in the distributor duct 3.

Also referring to FIG. 2, immediately upstream of the flow rate sensor 15 for measuring the flow rate of the stream $M_2$ the distributor duct 3 has a length portion a of circular cross section and of a length which is approximately 3 times the inner diameter of the length portion a. The cross-sectional circular configuration and particular length of the length portion a serves the aerodynamic purpose of quieting the stream flow therein, just before it passes through the flow rate sensor 15.

A practical embodiment of a flow divider (branch-off arrangement) for separating the stream $M_1$ into streams $M_2$ and $M_3$ is illustrated in FIG. 3. At the branch-off location 9a the inner space of the distributor duct 3 is divided by a separator (divider) plate 9c which is provided with apertures 9b. In this manner a starting length portion 9d of the branch conduit 9 is provided which is oriented in such a manner that the duct portions of the duct 3 immediately upstream and downstream of the divider plate 9c as well as the starting portion 9d of the branch conduit 9 are all oriented essentially co-directionally. For this purpose, the separator plate 9c extends at a small acute angle of approximately between 5°-15° to the length dimension of the immediately upstream portion of the duct 3 and constitutes, along a length portion, a common, air-pervious wall between a distributor duct portion 3a and the starting length portion 9d of the branch conduit 9. Further, at the downstream end of the separator plate 9c, the distributor duct 3 as well as the branch conduit 9 are at an obtuse angle to the duct portion 3a and the starting portion 9d to arrive at a parallel orientation with the distributor duct 3 immediately upstream of the branch-off location 9a.

While one wall of the starting length portion 9d is constituted by the separator plate 9c, another, opposite wall portion thereof is constituted by a gate 22 which extends substantially along the entire length of the separator plate 9c and which is pivotal towards and away from the separator plate 9c by virtue of its articulation at 21 in the zone of the upstream end of the separator plate 9c. Thus, by causing a pivotal motion of the gate 22 by a control device as described in connection with FIG. 1, the cross-sectional flow passage area of the branch conduit 9 in the branch conduit portion 9d is varied to thus alter the flow rate of the stream $M_3$ in the branch conduit 9.

Figure 5:
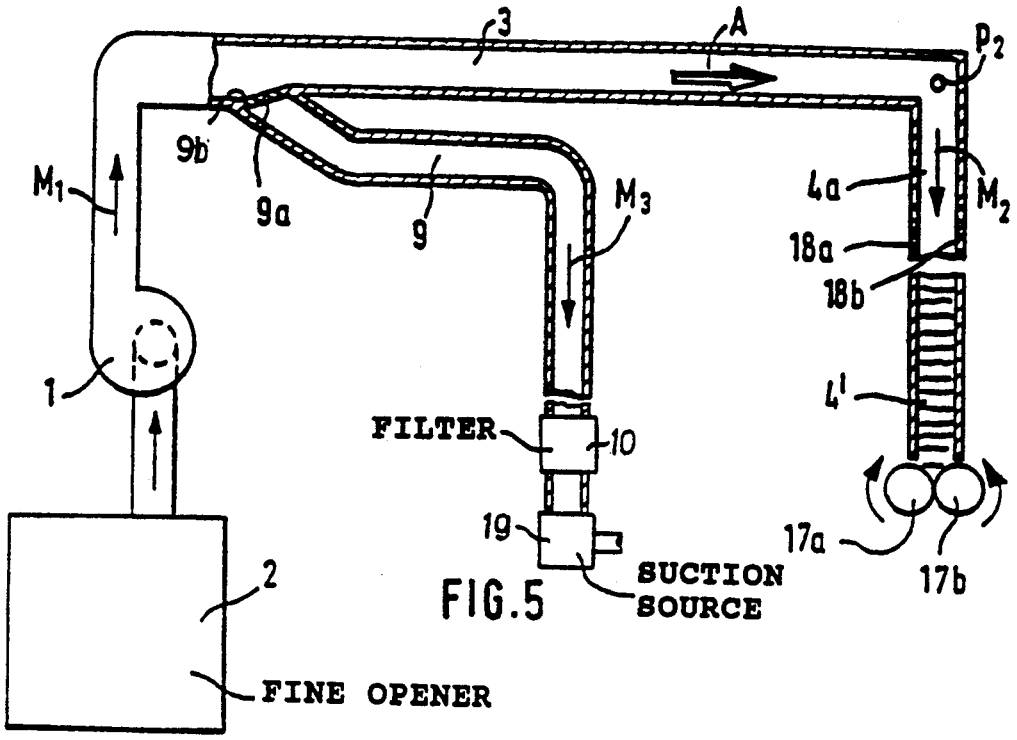
FIG. 5 is a schematic sectional view of further details of the embodiment of FIG. 4.

In the embodiment illustrated in FIGS. 4 and 5, the distributor duct 3 extends above a plurality of serially arranged card feeders 4 and is connected to the individual feed chutes 4a, 4b, 4c and 4d of the respective card feeders 4. The feeders 4a–4d may each be EXACTAFEED FBK models manufactured by Trützschler GmbH & Co. KG, Mönchengladbach, Germany. The tuft/air mixture in the distributor duct 3 is designated at A and the fiber tuft column in the feed chute 4a is designated at 4'.

An electronic pressure sensor 5 is disposed in the distributor duct 3 above the first feed chute 4a. The blower 1 draws the opened fiber material from the last beater station of the opening device—for example, from the fine opener 2—and delivers the fiber material in a conveying air stream through the distributor duct 3 to the feed chutes 4a–4d of the respective card feeders 4. Upon entrance of the air/fiber tuft mixture into the feed chutes 4a–4d, the conveying air leaves the respective feeder through air outlet openings 18a, 18b as shown in FIG. 5, and the fiber tufts are advanced into the feed chutes 4a–4d where fiber tuft columns are formed.

As the fiber columns begin to cover the air outlet openings 18a, 18b in the respective feed chutes 4a–4d, the pressure $p_2$ increases in the distributor duct 3. The pressure increase continues as the column level increases in the feed chutes 4a–4d and reaches its maximum when the air outlet openings 18a, 18b are fully covered in all feed chutes 4a–4d. At the upstream end of the distributor duct 3, above the first feed chute 4a, the electronic pressure sensor 5 emits signals which represent the pressure $p_2$ in the distributor duct 3, and which are utilized for regulating the material supply from the fine opener 2 to the blower 1.

The blower 1 operates continuously and drives air into the distributor duct 3, maintaining the pressure conditions therein.

Dependent on the fiber material requirements of the carding machines 6, fiber tufts are removed by the delivery rolls 17a, 17b from the feed chutes 4a–4d. As a consequence, the height of the columns in the feed chutes slowly drops, whereupon the air outlet openings 18a, 18b become partially free of the obturating fiber material. As a result, the pressure $p_2$ is reduced so that the speed of fiber conveyance from the fine opener 2 correspondingly increases and thus the blower 1 delivers an increased quantity of fiber material to the feed chutes 4a–4d.

The electronic pressure sensor 5 is connected to the regulator 7 which, in turn, is connected with a variable-speed electric motor 8 driving an opening roll in the fine opener 2. The regulator 7 is also connected to the throttle gate 11 with the intermediary of the setting member 12.

The branch conduit 9 is connected to a suction source 19 with the intermediary of a filter 10.

Figure 6:
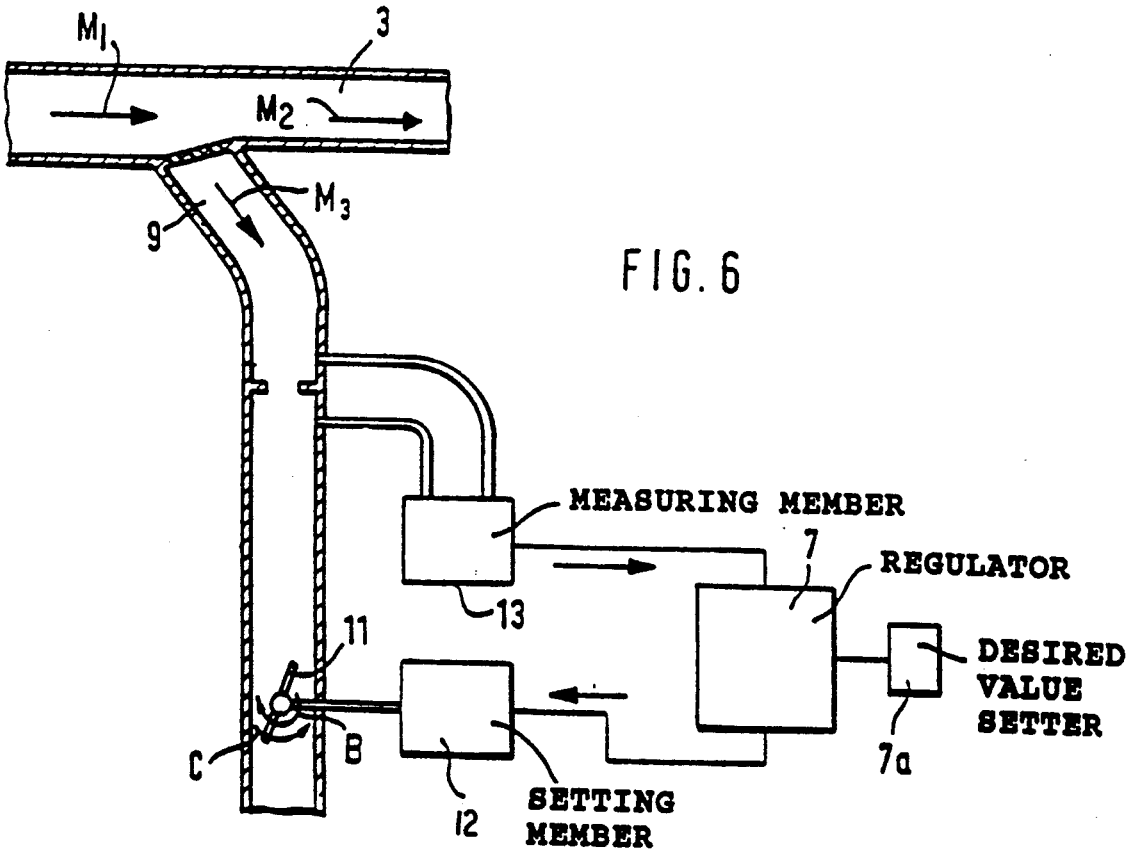
FIG. 6 is a schematic sectional view of another preferred embodiment, including a block diagram.

In the embodiment of FIGS. 5 and 6, a flow rate regulation of the stream $M_2$ is achieved according to the invention by regulating the flow rate of the branch stream $M_3$ in the branch conduit 9. Thus, if the sensed pressure $p_2$ in the distributor duct increases indicating, for example, that the fill level in the feed chutes 4a–4d has increased, it is desired to lower the flow rate of the supply stream $M_2$. Then, for this purpose, the flow rate of air stream $M_3$ in the branch conduit is increased by opening the throttle 11 which is effected by the regulator 7 in response to the signals that represent the pressure $p_2$.

Turning to FIG. 6, with the branch conduit 9 there is associated a measuring member 13 which responds to the flow rate of the air stream $M_3$ and which is connected via the regulator 7 (which has a desired value setter 7a) with the setting member 12 actuating the throttle valve 11 rotatable as indicated by the arrows B and C. The sensor 13 measures the flow rate of the stream $M_3$ upstream of the throttle valve 11. In this example the flow rate of stream $M_2$ in the distributor duct 3 is regulated according to the invention by sensing flow rate variations of the stream $M_3$ in the branch conduit 9.

Figure 7:
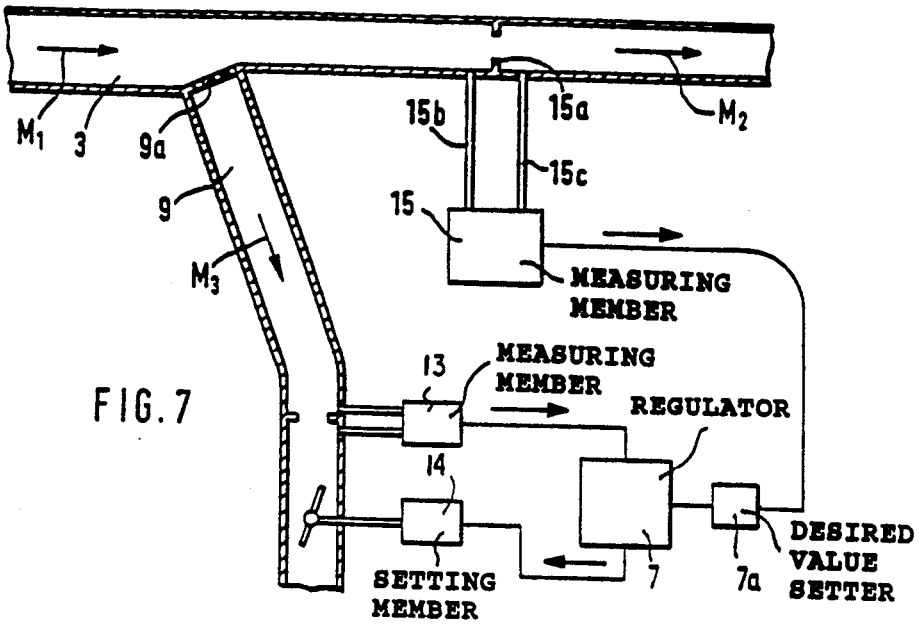
FIG. 7 is a schematic sectional view of still another preferred embodiment of the invention, including a block diagram.

Turning to FIG. 7, in the distributor duct 3, for sensing the flow rate of the air stream $M_2$, downstream of the branch-off location 9a there is arranged a measuring member 15 having a measuring element 15a and conduits 15b and 15c. The measuring member 15 is connected with the desired value setter 7a of the regulator 7. This embodiment for practicing the invention is generally a combination of the sensor features of the embodiments of FIGS. 1 and 6; the flow rate $M_2$ is thus regulated according to the invention by varying the flow rate $M_3$ in response to flow rate sensing of both streams $M_2$ and $M_3$.

Figure 8:
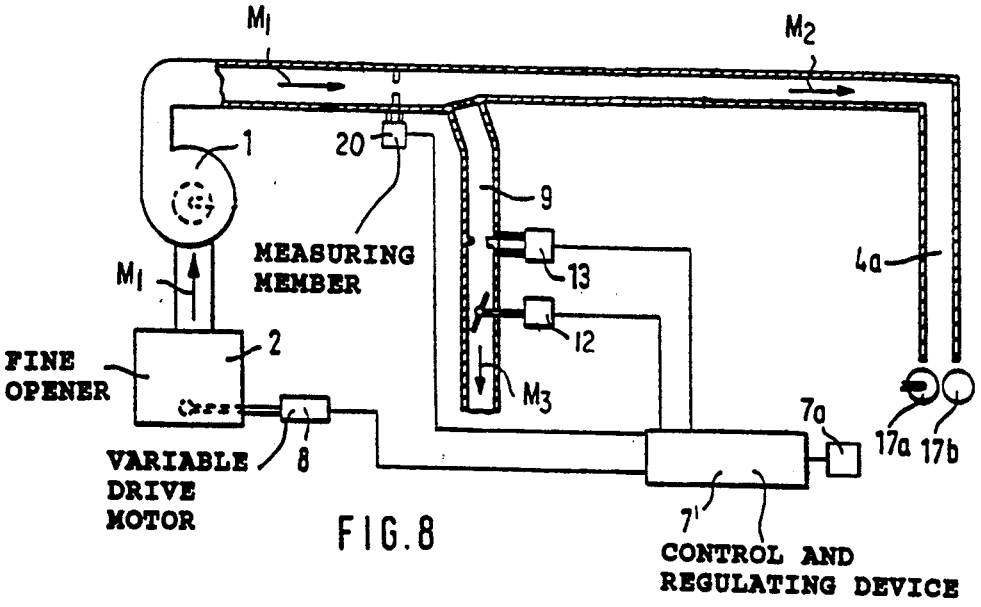
FIG. 8 is a schematic sectional view, with block diagram, of still another preferred embodiment of the invention.

In the embodiment illustrated in FIG. 8, the control and regulating device 7' is connected with the sensor 13 determining the flow rate of the air stream $M_3$, and a sensor 20 determining the flow rate of the fiber/air stream $M_1$. In this embodiment there is thus performed an indirect measurement of the flow rate of the stream $M_2$ and the control and regulating device may vary not only the flow rate $M_2$ by varying the flow rate $M_3$ in the branch conduit 9, but also varies the output of the fine opener 2 by altering the speed of the drive motor 8.

Figure 9:
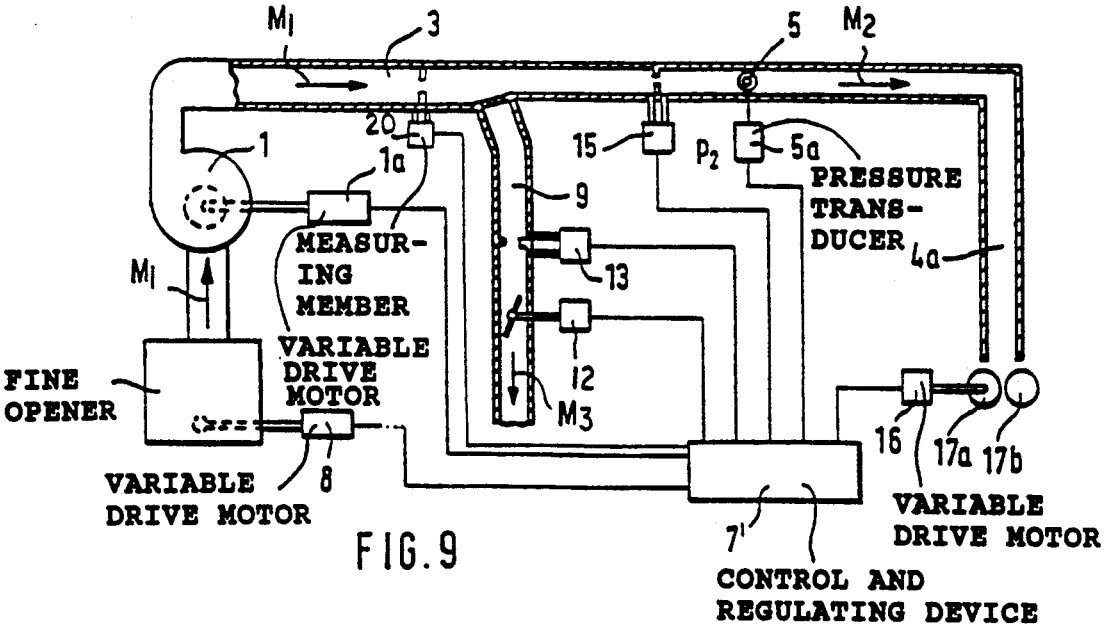
FIG. 9 is a schematic sectional view, with block diagram, of a further preferred embodiment.

Turning to FIG. 9, the distributor duct 3 contains the measuring member 15 for measuring the flow rate of the stream $M_2$ and the pressure sensor 5 which senses the pressure $p_2$ and which includes a pressure transducer 5a. The measuring member 15 and the transducer 5a are connected to a control and regulating device 7' which may be a microcomputer. Further, to the control and regulating device 7' there are connected a variable drive motor 1a for the blower 1, the variable drive motor 8 for the fine opener 2, the measuring member 13 for the air stream $M_3$, the setting member 12 for delivery rolls 17a, 17b of the feed chute 4a. There is further provided a measuring member 20 connected to the control and regulating device 7', for measuring the flow rate of the air stream $M_1$. This embodiment is thus in part a combination of the FIG. 7 and 8 embodiments.

It will be understood that the above description of the present invention is susceptible to various modifications, changes and adaptations, and the same are intended to be comprehended within the meaning and range of equivalents of the appended claims.

What is claimed is:

1. An apparatus for pneumatically delivering fiber tufts to a fiber processing machine, comprising:
   (a) a duct;
   (b) a blower having a pressure side and a suction side; said pressure side communicating with said duct for pneumatically driving fiber tufts therein in a stream $M_1$;
   (c) a branch conduit extending from said duct at a branch-off location situated downstream of said blower as viewed in a direction of flow of the stream $M_1$ for separating a stream $M_3$ from the stream $M_1$, leaving a stream $M_2$ to proceed in the duct downstream of said branch-off location;
   (d) means for preventing fiber tufts from entering from said duct into said branch conduit; and
   (e) flow varying means for changing a flow rate of the stream $M_3$ in said branch conduit; said flow varying means including a throttle mechanism situated in said branch conduit.

2. An apparatus as defined in claim 1, wherein said duct has, immediately upstream of said branch-off location, a length portion of circular cross section having an inner diameter; the length of said length portion being approximately three times said inner diameter.

3. An apparatus as defined in claim 1, wherein said flow varying means comprises a desired value transmitter and means for controlling said throttle mechanism as a function of a magnitude set in said desired value transmitter.

4. An apparatus as defined in claim 1, wherein said means for preventing fiber tufts from entering into said branch conduit comprises an apertured divider plate positioned in said duct at said branch-off location at an acute angle to a length dimension of said duct; the divider plate dividing an inner space of said duct into a duct length portion and a starting portion of said branch conduit; said duct length portion and said starting portion extending parallel to one another; said throttle mechanism comprising a throttle gate forming a longitudinal wall of said starting portion opposite said divider plate substantially along a length thereof; further comprising means for pivotally supporting an upstream end of said throttle gate to provide movement therefor towards and away from said divider plate.

5. An apparatus as defined in claim 1, further comprising suction means connected to said branch conduit for driving the stream $M_3$.

6. An apparatus as defined in claim 5, further comprising a filter connected to said branch conduit and said suction means.

7. An apparatus as defined in claim 1, wherein said flow varying means comprises a flow rate sensor exposed to at least one of the streams $M_2$ and $M_3$ in said duct and in said branch conduit, and a regulator having an input connected to an output of said flow rate sensor and an output operatively connected to said throttle mechanism.

8. An apparatus as defined in claim 7, wherein said flow rate sensor is positioned in said branch conduit for measuring the flow rate of the stream $M_3$.

9. An apparatus as defined in claim 7, wherein said flow rate sensor is positioned in said duct downstream of said branch-off location for measuring the flow rate of the stream $M_2$.

10. An apparatus as defined in claim 9, wherein said flow rate sensor is a first flow rate sensor; further comprising a second flow rate sensor positioned in said duct upstream of said branch-off location for measuring the flow rate of the stream $M_1$; said second flow rate sensor having an output connected to an input of said regulator.

11. An apparatus as defined in claim 9, wherein said flow rate sensor is a first flow rate sensor; further comprising a second flow rate sensor positioned in said branch conduit for measuring the flow rate of the stream $M_3$; said second flow rate sensor having an output connected to an input of said regulator.

12. An apparatus as defined in claim 11, further comprising a third flow rate sensor positioned in said duct upstream of said branch-off location for measuring the flow rate of the stream $M_1$; said second flow rate sensor having an output connected to an input of said regulator.

13. In a fiber processing line including a first fiber processing machine having an output; at least one feed chute having an input and an output; at least one second fiber processing machine having an input connected to the output of a respective said feed chute; a distributor duct connecting the output of the first fiber processing machine with the input of the feed chute; and a blower in the distributor duct for driving fiber tufts in an air stream $M_1$ in the duct in a flow direction from the first fiber processing machine to the second fiber processing machine; the improvement comprising (a) a branch conduit extending from said distributor duct from a branch location thereof for guiding an air stream $M_3$ from the air stream $M_1$ away from the distributor duct; said blower being situated in said distributor duct upstream of said branch location as viewed in said flow direction;

(b) means for preventing fiber tufts from entering from said duct into said branch conduit; and (c) means for setting a flow rate of the air stream $M_3$ in said branch conduit as a function of at least one of a fill level of the fiber in said feed chute and the quantity of second fiber processing machines.

14. A fiber processing line as defined in claim 13, wherein said branch conduit has an end bounding said distributor duct, said means for preventing fiber tufts from entering into said branch conduit comprising means defining air passage openings for allowing air to travel from the distributor duct into said branch conduit; said air passage openings being smaller than the expected smallest size of the fiber tufts.

15. A fiber processing line as defined in claim 13, wherein said branch conduit communicates with an ambient atmosphere.

16. A fiber processing line as defined in claim 13, wherein said means for setting a flow rate of the air stream $M_3$ includes variable throttle means for altering a flow passage cross section of said branch conduit.

17. A fiber processing line as defined in claim 13, wherein said means for setting a flow rate of the air stream $M_3$ includes means for determining an air pressure $p_2$ in the distributor duct.

18. A fiber processing line as defined in claim 13, wherein said means for setting a flow rate of the air stream $M_3$ comprises (a) sensor means for determining a flow rate of an air stream $M_1$ travelling in the distributor duct between the blower and a branching location of the branch conduit;

(b) throttle means for altering a flow passage cross section of said branch conduit; and (c) a control device having an input connected to said sensor means and an output connected to said throttle means for setting the flow rate of the air stream $M_3$ in said branch conduit as a function of the flow rate of the air stream $M_1$.

19. A fiber processing line as defined in claim 13, wherein said means for setting a flow rate of the air stream $M_3$ includes sensor means for determining a flow rate of an air stream $M_2$ travelling in the distributor duct from a branching location of the branch conduit to said feed chute and equalling $M_1$–$M_3$.

20. A fiber processing line as defined in claim 19, wherein said sensor means is situated in said distributor duct between said branching location and said feed chute.

21. A fiber processing line as defined in claim 13, wherein said means for setting a flow rate of the air stream $M_3$ comprises (a) sensor means for determining an air pressure $p_2$ in the distributor duct downstream of a branching location of said branch conduit as viewed in a direction of air flow in said distributor duct;

(b) throttle means for altering a flow passage cross section of said branch conduit; and (c) a control and regulating device having an input connected to said sensor means and an output connected to said throttle means for setting the flow rate of the air stream $M_3$ in said branch conduit as a function of the pressure $p_2$.

22. A fiber processing line as defined in claim 21, further comprising a memory connected to said control device and arranged for storing desired values.

23. A fiber processing line as defined in claim 21, wherein said control device comprises a microcomputer.

24. A fiber processing line as defined in claim 23, further comprising a desired value setter connected with said microcomputer.

25. A fiber processing line as defined in claim 13, wherein said means for setting a flow rate of the air stream $M_3$ comprises (a) sensor means for determining a flow rate of an air stream $M_2$ travelling in the distributor duct from a branching location of the branch conduit to said feed chute and equalling $M_1$–$M_3$;

(b) throttle means for altering a flow passage cross section of said branch conduit; and (c) a control device having an input connected to said sensor means and an output connected to said throttle means for setting the flow rate of the air stream $M_3$ in said branch conduit as a function of the flow rate of the air stream $M_2$.

26. A fiber processing line as defined in claim 25, further comprising a memory connected to said control device and arranged for storing desired values.

27. A fiber processing line as defined in claim 25, wherein said control device comprises a microcomputer.

28. A fiber processing line as defined in claim 27, further comprising a desired value setter connected with said microcomputer.

29. A fiber processing line as defined in claim 28, wherein said desired value setter is connected with said sensor means.

30. An apparatus for pneumatically delivering fiber tufts in a duct to a fiber processing machine, comprising:

(a) means for generating an air stream $M_1$ for driving the air stream $M_1$ with the fiber tufts through the duct;

(b) means for branching off a stream $M_3$ from the stream $M_1$ at a branch-off location upstream of the fiber processing machine as viewed in a direction of stream flow in the duct for leaving a stream $M_2$ in the duct downstream of the branch-off location;

(c) means for preventing fiber tufts from entering from said duct into said branch conduit; and (d) means for directly varying the flow rate of the stream $M_3$ for indirectly varying the flow rate of the stream $M_2$ in the duct.

31. A method of pneumatically delivering fiber tufts in a duct to a fiber processing machine, comprising the following steps:

(a) generating an air stream $M_1$ and driving the air stream $M_1$ with the fiber tufts through the duct;

(b) branching off a stream $M_3$ from the stream $M_1$ at a branch-off location upstream of the fiber processing machine as viewed in a direction of stream flow in the duct for leaving a stream $M_2$ in the duct downstream of the branch-off location;

(c) preventing fiber tufts from entering from said duct into said branch conduit; and (d) directly varying the flow rate of the stream $M_3$ for indirectly varying the flow rate of the stream $M_2$ in the duct.

32. A method as defined in claim 31, wherein the step of varying the flow rate includes the steps of measuring the flow rate of the stream $M_2$ in the duct and regulating the flow rate of the stream $M_3$ based on a desired value.

* * * * *